US007202763B2

(12) United States Patent
Six

(10) Patent No.: US 7,202,763 B2
(45) Date of Patent: Apr. 10, 2007

(54) MICRO-ELECTROMECHANICAL SWITCHING DEVICE

(75) Inventor: Jean-Claude Six, Saint Contest (FR)

(73) Assignee: NXP B.V., Eindhoven (NL)

( * ) Notice: Subject to any disclaimer, the term of this patent is extended or adjusted under 35 U.S.C. 154(b) by 50 days.

(21) Appl. No.: 10/528,623

(22) PCT Filed: Sep. 15, 2003

(86) PCT No.: PCT/IB03/04045

§ 371 (c)(1),
(2), (4) Date: Mar. 22, 2005

(87) PCT Pub. No.: WO2004/030006

PCT Pub. Date: Apr. 8, 2004

(65) Prior Publication Data

US 2005/0270127 A1 Dec. 8, 2005

(30) Foreign Application Priority Data

Sep. 25, 2002 (EP) ..... 02292350

(51) Int. Cl.
*H01H 51/22* (2006.01)

(52) U.S. Cl. ..... 335/78

(58) Field of Classification Search ..... 335/78; 200/181

See application file for complete search history.

(56) References Cited

U.S. PATENT DOCUMENTS

| | | | | |
|---|---|---|---|---|
| 6,094,116 | A | 7/2000 | Tai et al. | |
| 6,124,650 | A * | 9/2000 | Bishop et al. | 310/40 MM |
| 6,229,684 | B1 * | 5/2001 | Cowen et al. | 361/278 |
| 6,646,215 | B1 * | 11/2003 | Nelson | 200/181 |
| 6,657,525 | B1 * | 12/2003 | Dickens et al. | 335/78 |
| 6,657,832 | B2 * | 12/2003 | Williams et al. | 361/15 |

* cited by examiner

*Primary Examiner*—Elvin Enad
*Assistant Examiner*—Bernard Rojas

(57) ABSTRACT

The invention relates to an electromechanical switching device including at least one pair of inductive elements electrically connected in series, said inductive elements being intended to generate two magnetic fields when current is flowing through said inductive elements, the interaction between these two fields resulting in a displacement of at least one of the inductive elements and a displacement of a mobile contact element linked to said at least one inductive element and intended to switch between two positions, at least one of these positions enabling an electrical connection between at least two conductive elements. The invention uses the mechanical forces exerted on at least one inductive element able to move thanks to two electro-magnetic fields oppositely generated by two inductive elements to activate a switch effect between two positions.

10 Claims, 3 Drawing Sheets

MICRO-ELECTROMECHANICAL SWITCHING DEVICE

FIELD OF THE INVENTION

This document relates to a micro-electromechanical switching device and to a process for fabricating such a micro-electromechanical switching device.

BACKGROUND OF THE INVENTION

Electromechanical relays are switching devices typically used to control high power devices. Such relays generally comprise two primary components: a movable conductive cantilever and an inductive element, generally an electromagnetic coil. When activated, the electromagnetic coil exerts a magnetic force on the beam in the same way that a magnet will pick up a nail. This causes the beam to be pulled toward the coil, down onto an electrical contact, closing the relay by creating an electrical connection. Said electrical connection may be galvanic or more often based on a capacity variation. The more important the capacity is, the more it will enable a current having a given frequency crossing the switching device. These micro-electromechanical relays have been down-sized in order to fit the needs of modern electronic systems. The micro-electromechanical relays do not present limitations observed for solid-state relays that require large and expensive heat sinks as resistances of such devices on ON and OFF position are generally one order of magnitude higher than for electromechanical switches and cause a strong heating effect.

For example, the document U.S. Pat. No. 6,094,116 proposes an improved micro-electromagnetic switching device. The structure proposed in this document allows a unique powerless hold feature. A magnetic layer is first deposited on the substrate. An electromagnetic coil is then created adjacent to this material. A deflectable structure in a magnetic material is then laid down in order to have a portion over or adjacent to at least one electrical contact. In operation, current passes through the coil, causing the deflectable structure to deflect, and either make or break contact with the electrical contacts.

This implementation of an electromechanical switch offers a good miniaturization but it requires the deposition of a magnetic material and requires specific current or voltages to switch from one position to the other.

SUMMARY OF THE INVENTION

It is an object of the present invention to propose a micro-electromagnetic switching device having many advantages regarding the state of the art and, especially not requiring the deposition of a magnetic material.

To this end, an electromechanical switching device according to the invention includes at least one pair of inductive elements electrically connected in series, said inductive elements being intended to generate two magnetic fields when current is flowing through said inductive elements, the interaction between these two fields resulting in a displacement of at least one of the inductive elements and a displacement of a mobile contact element linked to said at least one inductive element and intended to switch between two positions, at least one of these positions enabling an electrical connection between at least two conductive elements.

The invention uses the mechanical forces exerted on at least one inductive element able to move thanks to two electromagnetic fields distinctly generated by two inductive elements to activate a switch effect between two positions. Advantageously said two magnetic fields are opposite. The current in the inductive elements plays the role of a control line enabling the switch between two positions of the mobile contact element. Consequently, the inductive elements of the switch can simply be inserted on a supply line of a function. Said switch can then control part of this same function or another function. No extra current dedicated to the control of the switch is needed. Effectively, whatever the sign of the current is, the switch will have the same behavior. Moreover, it has to be noted that this switch is well integrated and small.

In a specific embodiment, an insulation is provided on conductive elements in order to calibrate given values of capacitors between said contact element and said conductive elements during the connection. The value of the capacitor will then decrease significantly during the switch to the position where no connection is realized. In this case, the switch is based on a variation of capacitance.

In a simple embodiment, the two inductive elements of a pair are in distinct and parallel planes and superimposed on each other. A conductive link is provided between the two inductive elements in order to connect them in series. Advantageously, the contact element is implemented in one of these planes.

In a simple implementation of the invention, inductive elements are electromagnetic coils coiled in opposite directions. According to the invention, the central points of the coils advantageously link the two coils of one pair. One of the coils and, consequently, the mobile element attached to this coil, is free to move. The separation between the two coils of one pair is advantageously realized by under-etching an oxide layered between the two coils according to a process of the invention presented in the following.

In such an implementation, the coils are used as DC inductors as they generate magnetic fields, as guiding elements as they guide the movement of the mobile element, springs as their return force helps in the establishment of the non-activated position when no current is flowing into the coils and blocking coils in RF as they are cutting high frequencies that could cause noise in the circuit linked to the switch. Consequently, the invention helps at having a very good behavior for a switch as it provides other advantageous functions by itself.

In a preferred embodiment, a second pair of inductive elements is connected to the first pair by connection of one of the inductive elements of the second pair to the contact element.

It will be demonstrated hereinafter that, for example, the use of four coils is the simplest way to realize a return of the current on the plane of the fixed inductive elements.

In an advantageous embodiment, said switching device is placed in a cavity. For example, this cavity is realized by flip-chip technologies. According to an alternative of the invention, said cavity is provided with an electrode intended to enter into contact with said contact element. This alternative allows having two positions that do not consume any power. Effectively, an impulsive current is only necessary to make the mobile element stick to the electrode. This current impulse does not require any power consumption and keeping the mobile element stuck to the electrode does not require any power, a voltage being sufficient.

The invention finds its application in any circuit where a switch is advantageously provided. Especially the switch according to the invention can be used in a circuit where a function of reception is activated by a current, the switch according to the invention being placed between this function and the element from which the supply current for this function is generated, said switch being intended to control part of this function or another function.

The invention also relates to a method to fabricate an electromechanical switch according to the invention.

BRIEF DESCRIPTION OF THE DRAWINGS

The invention is described hereafter in detail with reference to the diagrammatic Figures wherein.

DESCRIPTION OF EMBODIMENTS

The micro-switching device of the present invention is fabricated by a process that is based upon technologies ordinarily used by integrated circuit manufacturers and eliminates the need for expensive device assembly. A process utilizing classical micro-electronic and micro-machining technologies will be described below.

Figure 1:
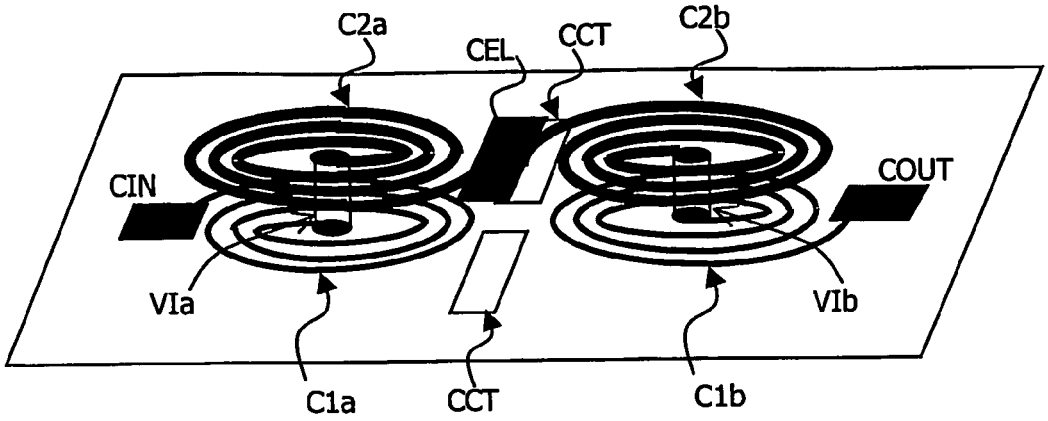
FIG. 1 shows a perspective schematic view of a first alternative of the invention.

Referring to FIG. 1, a micro-electromechanical switch according to the invention comprises two pairs of inductive elements C1*a*, C2*a* and C1*b*, C2*b*. This Figure is representative of a preferred embodiment of the invention but is not described in exclusion of other ways to realize the invention. Each of these pairs includes a first inductive element C1, for example an electromagnetic coil, in a first plane and a second inductive element C2, for example an electromagnetic coil in a second plane parallel to the first one. Said second inductive element C2*a* (or C2*b*) is superposed on the first corresponding inductive element C1*a*(or C1*b*), connected with it by a conductive via VIa (or VIb). Said second inductive element C2 is fabricated in order to produce a magnetic field opposite to the one created by the first inductive element C1 as soon as a current is flowing through these inductive elements. The same current is flowing through the four inductive elements as they are connected in series. One of the two inductive elements of each pair is mobile relative to the other. In the case described in FIG. 1, C2 is mobile relative to C1. Advantageously, the inductive elements are electromagnetic coils, as represented on FIG. 1. In such an advantageous and simple implementation, the corresponding coils are simply coiled in opposite directions in order to produce opposite magnetic field as soon as a current is flowing through said coils. The switch represented by the four coils presents an input connection CIN and an output connection COUT in order that a current can be provided to the switch. Such a current will control the switching. The switch will be called activated when a current flows in the inductive elements and non-activated when no current flows.

According to the preferred embodiment of the invention, as presented in FIG. 1, when current is flowing in coils coiled in opposite ways, the second coils C2 will lift by the electromagnetic force. According to the invention a contact element CEL is for example attached to the two second coils C2. This contact element CEL is mobile as well as the second coils and will lift with the second coils C2 causing a first position of the switch.

When no current is flowing in the coils, the mobile element is generally part of an RF capacitor, for example polarized in DC, so that an electrostatic force will stick the mobile contact element CEL to conductive elements CCT for example realized on the plane of the first coil. This causes a second position of the switch. The polarization of said capacity may be optional as the natural adhesion of materials may be sufficient to maintain the contact element CEL close to conductive elements CCT.

Said contact element CEL is then intended to switch between two positions, called first position, here corresponding to the activated switch, and second position, here corresponding to the non-activated switch. These two positions are not represented in FIG. 1 for reasons of clarity of the drawing. Nevertheless, FIG. 2 helps understanding the two positions by representing this time the contact element CEL in the second position in a full line compared to the first position that is represented in FIG. 1 and represented in FIG. 2 by a dotted line.

In said first position, so when the switch is activated as represented in FIG. 1, the contact element CEL is far from conductive elements CCT provided on the first plane, a weak capacitance being observed between the contact element CEL and the conductive elements CCT. Effectively, the contact element is part of the RF capacitor and the value of the capacitor decreases significantly when the switch is activated. In the preferred embodiment represented in FIGS. 1 and 2, when the switch is activated, the switch does not provide a connection path between the conductive elements CCT.

In said second position, the contact element is close to conductive elements CCT provided on the first plane. This second position of the contact element CEL generates a connection path between the conductive elements CCT. This connection path may be for example galvanic or based on a variation of capacitance.

In case of a switch intended to enable a galvanic contact between the conductive elements CCT, said mobile contact element CEL or a part of the mobile element CEL or an element linked with the mobile contact element CEL comes into galvanic contact with the conductive elements CCT. In this case, in order to have good contacts, special materials should constitute the conductive elements and the mobile element (or the part of it or the element linked to it): gold, platinum. In this case, advantageously, part of the mobile element is intended to serve in a capacitor for maintaining the mobile contact element CEL in the second position by the electrostatic force and part of the mobile contact element CEL is properly dedicated to serve for the galvanic contacts.

In case of a switch based on a variation of capacitance, the connection path comprises the formation of two capacitors in series. In second position, the values of the capacitors are higher than in the first position, the values of the capacitors decreasing significantly when the switch is activated. Said capacitors enable a current of a given frequency to go through the switch from one conductive element CCT to the other conductive element CCT, said current being reproduced from one capacitor to the other by the common electrode constituted by the mobile contact element CEL. In a specific embodiment, insulation is provided on conductive elements CCT in order to calibrate the values of capacitors between said contact element CEL and said conductive elements CCT. Maintaining the contact element CEL and connection path is then advantageously realized by the same contact element CEL.

It has also to be underlined that in the preferred embodiment represented in FIG. 1, the two pairs of coils help the mechanical guidance of the displacement of the different mobile part of a switch according to the invention. They have also the role of springs and exert a kind of return force that goes to the direction of the electrostatic force that will stick the mobile contact element CEL onto the conductive elements CCT. This electrostatic force is advantageously generated by the polarization of the capacitor in DC as described in FIG. 2 representing an electrical assembly of a switch according to the invention.

Figure 2:
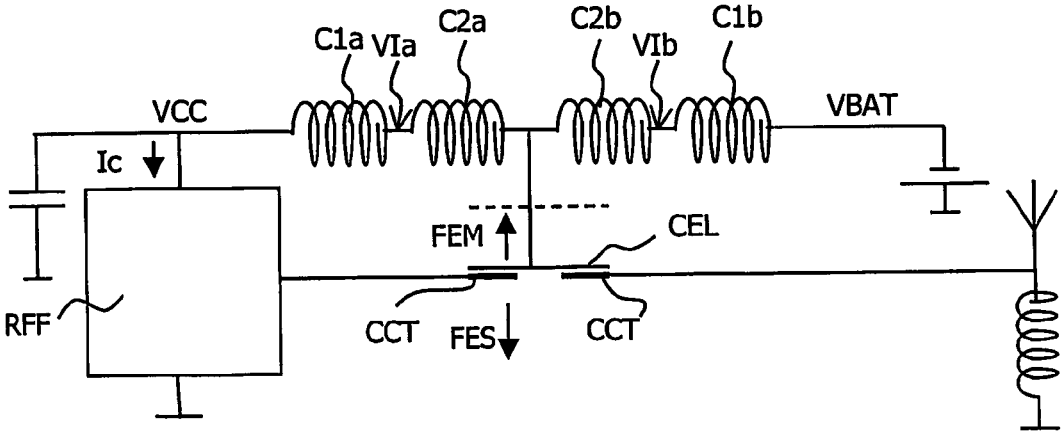
FIG. 2 shows an electrical assembly according to the first alternative of the invention, this electrical assembly being an illustration of a circuit according to the invention.

Referring to FIG. 2, a possibility of assembly for the preferred embodiment of the invention is presented. In this figure are represented the four different coils connected in series C1*a*, C2*a*, C2*b* and C1*b*. The two coils of a pair are linked by conductive vias VIa and VIb as represented above. The contact element CEL is linked to a point situated between C2*a* and C2*b* as represented physically in FIG. 1. This contact element CEL is moving between two positions: a first position in a dotted line and a second position in a full line. The switching between these two positions is realized by the action of different forces. The electromagnetic force FEM generated by the superposed coils makes the contact element CEL and the second coils C2 lift. An electrostatic force FES makes the contact element CEL contact conductive elements CCT layered on the first plane. This electrostatic force FES is generated by the fact that the capacitor, materialized by the contact element CEL and the conductive elements CCT on the first plane, is for example polarized, by voltage VCC.

A functional circuit RFF is linked to the switch according to the invention. As a simple current flowing through the coils is necessary to activate the switch, the latter can be placed simply in series with a supply current line of this functional circuit RFF. In this case, no extra current is required for activation of the switch. This is an important advantage of the invention. As soon as the functioning of the functional circuit RFF is required, the supply current Ic of the functional circuit RFF flows in the coils and activates the switch. The functioning of the functional circuit RFF can be independently launched by known means: a control link or serial bus. VBAT is the voltage that is supplied to the functional circuit. Such a functional circuit can be any consumer electronic circuit realizing a specific electronic function. For example, this functional circuit RFF is a circuit managing the transmission protocols that control power amplifier functions (active during transmission) and reception functions (active during reception). Variable currents absorbed by these functions can then be used to control the coils and activate the switch. Such a functional circuit is for example implemented in a telecom terminal where two operating modes are used: transmission and reception. Then the invention also relates to a circuit including a microelectromechanical switching device as described above for implementing a switch between two types of behavior of said circuit. Said circuit includes functional circuits or functional parts that can be activated or deactivated using the switch. FIG. 2 gives a schematic representation of such a circuit.

Figure 6:
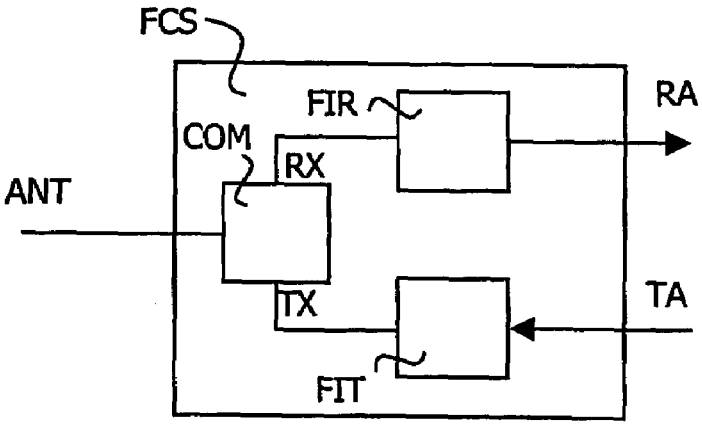
FIG. 6 is a block diagram of a circuit according to a preferred application of the invention.

In a particular application, the invention may advantageously be implemented in a circuit FCS as represented in FIG. 6. This circuit includes a reception chain for received signals RX and a transmission chain for transmitted signals TX with a commutation device COM linked to a line common for reception and transmission, for example an antenna ANT. Reception and transmission chains each include at least a filter, FIR and FIT respectively, which is linked to an amplifier, RA and TA respectively. Commutation device COM is advantageously realized with switching devices according to the invention and implemented as explained above. According to the preferred embodiment of the invention, when the switch is activated, no connection path is provided. Consequently, a switch according to the preferred embodiment of the invention can be advantageously implemented to close a contact for the functioning of a reception function when the transmission function is not activated and consequently no supply current is provided to this transmission function. Another switch according to the preferred embodiment of the invention can be implemented to do the opposite task: when activated by the supply current of a reception function open a connection path for a transmission function. Many kinds of commutation devices can then be realized using a switching device or several switching devices of the invention in combination. In the following are also represented switching devices that enable a connection path to be established while the switch is activated.

Figure 7:
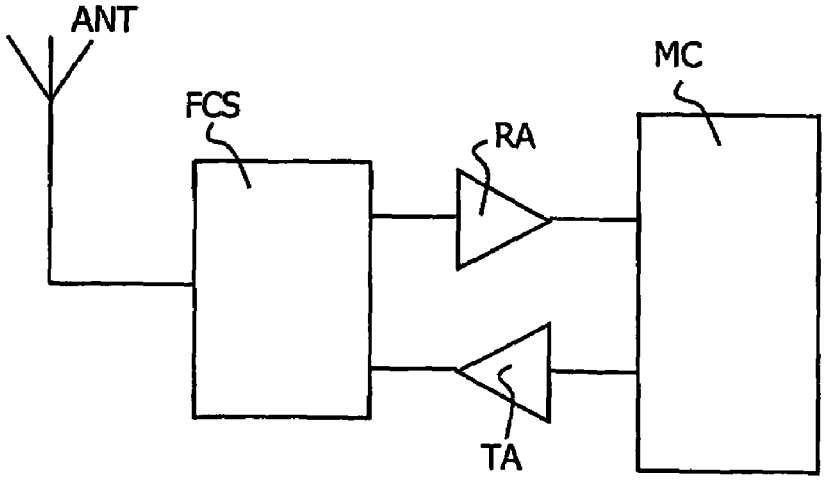
FIG. 7 is a schematic diagram of a telecommunication apparatus wherein the invention is advantageously implemented.

A circuit FCS as represented in FIG. 6 is advantageously used in a electronic telecommunication apparatus as represented in FIG. 7 and intended to receive and transmit signals. This telecommunication apparatus advantageously implements a circuit FCS as described hereinabove. Moreover it includes at least an antenna ANT, amplifiers RA and TA and processing means to process signals MC.

The preferred embodiment of the invention has been described but various other embodiments based on the principle of the invention are included in the scope of the invention. Several examples will follow to show the diversity of possibilities offered by the principle of the invention defined by the claims. These examples present among other things the possibility to use a single pair of inductive elements, the possibility to have an activated switch generating a connection path (as opposed to the preferred embodiment), the possibility to have two powerless positions of the switch.

To protect the switch as described hereinabove it may be useful to put it in a closed cavity. This cavity is also advantageously hermetic. The cavity can be realized, for example, by flip-chip technologies.

According to a basic embodiment of the invention, only one pair of inductive elements is realized. In this case, the current flowing through the first and second inductive element has to be returned on a non-mobile plane. Consequently, at least a flexible conductive via, enabling the second coil to be deformed, has to be provided. Quite an important deformation is required for such a conductive via that has to be quite a long one in zigzag or in spiral. Such a conductive via takes place in the integrated circuit. Consequently, it is highly advantageous, according to the preferred embodiment, to use two pairs of spirals as inductive elements as the place is taken in any case. Moreover, spirals allow having a long link on a very small surface. Nevertheless, the invention can be implemented with a single pair of inductive elements: a specific example will be given hereinafter.

Figure 5:
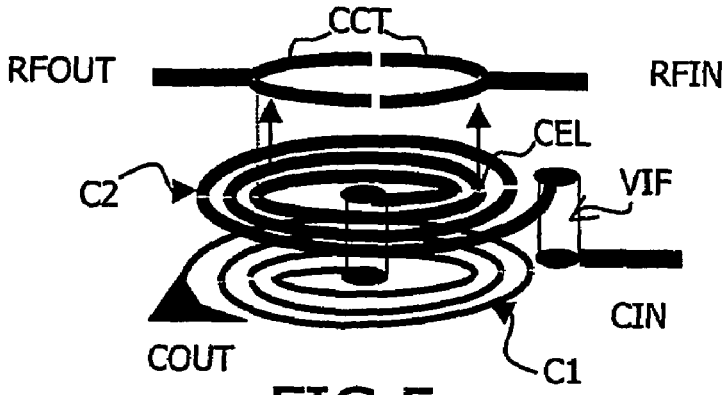
FIG. 5 shows a perspective schematic view of a second alternative of the invention.

An advantageous embodiment of a simple implementation using a single pair of coils in a cavity is represented in FIG. 5. A simple conductive flexible via VIF is provided to enable the displacement of the second coil C2 and the circulation of the current in both coils between the two connection pads CIN and COUT. The conductive via could also be non-flexible, the spires of the coil C2 serving as flexible part, only some central spires of C2 being displaced according to the invention. This displacement is then generally observed to be more important for the internal spires than for the external one as the external one is more or less constrained by the presence of the conductive via VIF. In this case the mobile contact element CEL can be one of the internal spire of the coil C2 and conductive elements CCT are provided on top of the cavity. The cavity is not represented for reasons of clarity. The connection is realized by displacement of the spires of the coil C2 according to the principle of the invention. In this case, the position where a connection path is realized corresponds to the one where the switch is activated by a current flowing in the coils C1 and C2, the second coil C2 being consequently in a "high" position. Here the activation of the switch enables a position where a connection path is established opposite to the behavior of the switch of the preferred embodiment.

Figure 3:
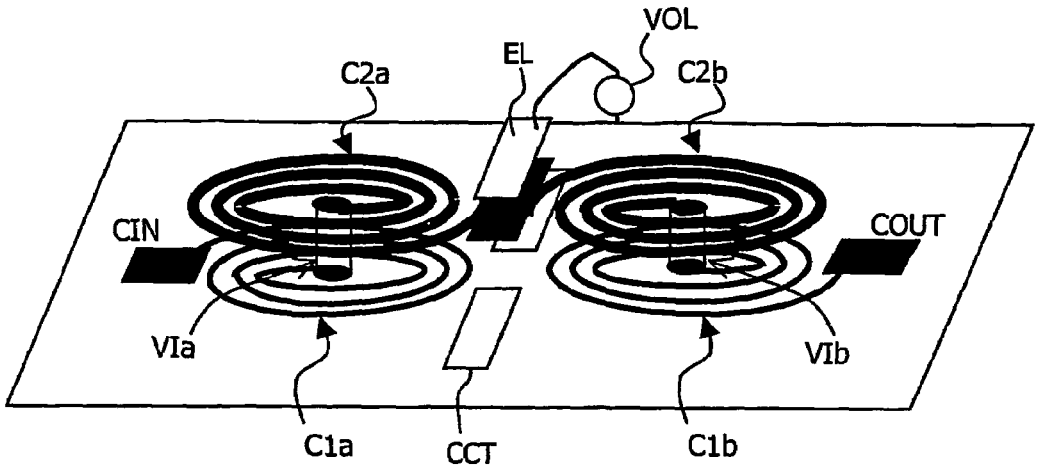
FIG. 3 shows a perspective schematic view of a second alternative of the invention.
Figure 4:
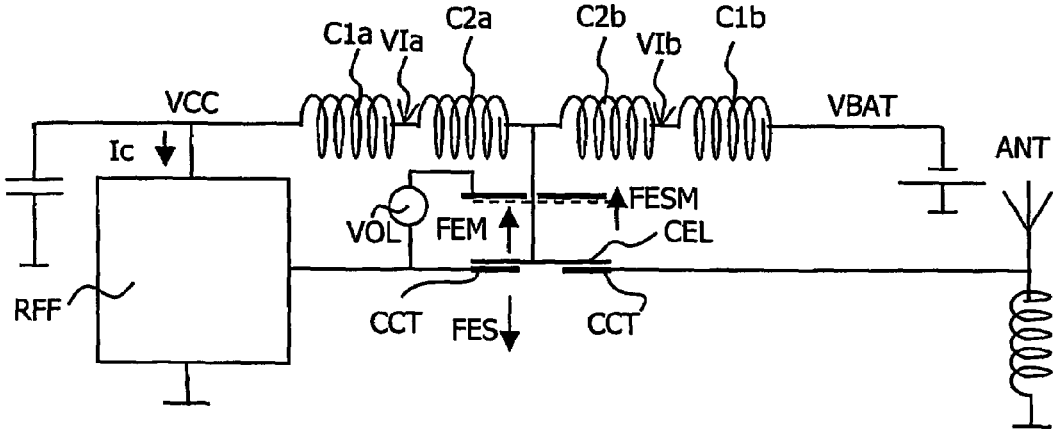
FIG. 4 shows an electrical assembly according to the second alternative of the invention, this electrical assembly being an illustration of a circuit according to the invention.

Referring to FIGS. 3 and 4, an alternative of the invention comprises adding an electrode EL to the side of the cavity opposite to the conductive elements CCT layered on the first plane. This electrode EL is for example linked to a voltage generator VOL. No current flows in this electrode, so no power is consumed. Nevertheless, the voltage generator VOL allows a second electrostatic force FESM to make the mobile contact element CEL stick on this electrode EL. The voltage generated can be, for example, of the order of one to ten volts. This voltage generator VOL can be activated as soon as, for example a current is flowing in the coils. The advantage is that the contact element CEL can be kept in the "high" position without any circulation of current in the coils. To make the contact element CEL return to the "low" position (where a connection path is realized), the voltage has simply to be put to zero. The return force generated by the coils that constitute springs, helps this return. In this alternative of the invention, the switch has two stable positions that do not necessitate any power consumption. Only an energy impulse realized by a current impulse in inductive elements is necessary to make the contact element CEL change its position by electromagnetic force.

The invention also relates to a process to fabricate a switch or relay intended to switch between two positions, at least one of these positions enabling an electrical connection between at least two conductive elements. Such a process uses techniques conventionally used in integrated circuitry. First, at least one inductive element is formed. Several possibilities using classical microelectronic process exist to form such an inductive element. For example a layer of conductive material is deposited. A mask then allows etching the conductive material in order to form the inductive element, for example a coil. The conductive material is generally a metal as for example, aluminum. It is also possible to form a mold structure defining at least one location for at least one electromagnetic coil. Etching a substrate using a mask can form such a mold structure. This mold structure is for example realized in a high impedance substrate to have a good insulation of the RF contacts. Within the mold structure is deposited a conductive material, generally a first metal, in sufficient quantity to build up at least one electromagnetic coil.

Then, an under-etchable material is deposited above said inductive element. A conductive link is arranged through the under-etchable material to then connect the two inductive elements. The under-etchable material is, for example, oxide.

Advantageously an insulating material is deposited between the first inductive element and the under-etchable material. This insulating material is not under-etchable and constitutes a kind of protective layer on the inductive element. Such a protective layer can, for example, be constituted by nitride. For example, 0.4 μm of nitride and 1 μm of oxide are deposited.

At least one second inductive element is formed above said under-etchable material. The under-etchable material is then under-etched. For example a layer of conductive material is deposited. A mask then allows to etch the inductive element, for example a coil.

The conductive material is generally a metal as for example, aluminum. The under-etchable material is then under-etched in order to free the second coil. Simple via interconnecting metal layers realize contacts between the two coils of a pair. The two first coils in the first plane and second coils in the second plane can be realized in different metals or in the same metal. Insulating material can be layered to calibrate the values of capacitors causing the connection path to form. As seen above the conductive elements to form a connection path in the switch according to the invention can be implemented on the first plane in the same processing step as the formation of the first coil or on top of a cavity. Those conductive elements can have any position regarding a switch of the invention as soon as the contact element can form a connection path by moving towards said conductive elements.

An example of implementation is proposed according to the preferred embodiment of the invention with two pairs of concentric coils in two distinct planes. These coils have 7 spires. The first one is for example constituted by aluminum and is 1 μm thick and 6 μm large. The second one is for example constituted by aluminum and is 3 μm thick and 5 μm large. As an example, a current of 60 mA flowing in the coils generates displacement of 20 to 50 μm of the coils. According to the different geometry, the values of the capacities assuring the RF switch function are around 0.1 to 1 pF and will decrease when the contact element is far from the conductive elements that realize the contact. This example is not restrictive and many other dimensions and physical characteristics can be changed without being excluded from the scope of the invention. Any form of inductive element different from a coil can also be used in the invention. Nevertheless, the advantage of coils is that they behave as blocking coils in RF as they cut the high frequency signals that can generate parasitic ways. They behave effectively as self-inductances at high frequencies.

The invention claimed is:

1. A micro-electromechanical switching device including at least one pair of inductive elements electrically connected in series, said inductive elements being intended to generate two magnetic fields when current is flowing through said inductive elements, the interaction between these two fields resulting in a displacement of at least one of the inductive elements and a displacement of a mobile contact element linked to said at least one inductive element and intended to switch between two positions, at least one of said positions enabling an electrical connection between at least two conductive elements.

2. A micro-electromechanical switching device according to claim 1, wherein said two magnetic fields are opposite.

3. A micro-electromechanical switching device according to claim 1, wherein an insulation is provided on conductive elements in order to calibrate values of capacities between said contact element and said conductive elements.

4. A micro-electromechanical switching device according to claim 1, wherein said inductive elements are in two distinct and parallel planes and superimposed on each other.

5. A micro-electromechanical switching device according to claim 1, wherein inductive elements are electromagnetic coils coiled in opposite ways.

6. A micro-electromechanical switching device according to claim 1, wherein a second pair of inductive elements is connected to the first pair by connection of one of the inductive elements of the second pair to the contact element.

7. A micro-electromechanical switching device according to claim 1, wherein said device is placed in a cavity, said cavity being provided with an electrode intended to enter in contact with said contact element.

8. A circuit including at least one micro-electromechanical switching device as claimed in claim 1, for causing a commutation to occur between two operating modes of at least a functional part of said circuit.

9. A telecommunication electronic apparatus including at least an antenna, at least an amplifier, processing means to process signals, said processing means comprising at least a circuit as claimed in claim 7.

10. A method for manufacturing a micro-electromechanical switching device intended to switch between two positions, at least one of said positions enabling an electrical connection between at least two conductive elements, by the steps of:

forming at least one first inductive element on a substrate, depositing an under-etchable material above said inductive element, forming at least one second inductive element above said under-etchable material, a conductive link being arranged through this under-etchable material to connect the two inductive elements, forming a contact element linked to said second inductive element above said under-etchable material, under-etching the under-etchable material.

* * * * *